US008213661B2

(12) United States Patent
Hinke

(10) Patent No.: US 8,213,661 B2
(45) Date of Patent: Jul. 3, 2012

(54) MICROPHONE

(75) Inventor: Claus-Peter Hinke, Burgdorf (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 326 days.

(21) Appl. No.: 12/622,696

(22) Filed: Nov. 20, 2009

(65) Prior Publication Data

US 2010/0135514 A1 Jun. 3, 2010

(30) Foreign Application Priority Data

Nov. 24, 2008 (DE) ..... 10 2008 058 787

(51) Int. Cl.
*H04R 11/04* (2006.01)

(52) U.S. Cl. ..... 381/355; 381/174

(58) Field of Classification Search ..... 381/355, 381/170, 313, 401, 394, 174, 175, 191, 369, 381/356, 357, 358
See application file for complete search history.

(56) References Cited

U.S. PATENT DOCUMENTS

| | | | | |
|---|---|---|---|---|
| 2,678,967 | A | 5/1954 | Grosskopf | |
| 3,146,308 | A | 8/1964 | Gorike | |
| 5,101,543 | A * | 4/1992 | Cote et al. | 29/25.41 |
| 5,335,282 | A | 8/1994 | Cardas | |
| 6,031,922 | A * | 2/2000 | Tibbetts | 381/313 |
| 6,075,867 | A | 6/2000 | Bay et al. | |
| 6,295,365 | B1 | 9/2001 | Ota | |
| 2003/0174856 | A1 * | 9/2003 | Johannsen et al. | 381/401 |
| 2004/0005070 | A1 | 1/2004 | Kanda et al. | |
| 2004/0136558 | A1 * | 7/2004 | Usuki et al. | 381/394 |
| 2005/0069164 | A1 * | 3/2005 | Muthuswamy et al. | 381/369 |
| 2007/0242847 | A1 * | 10/2007 | Gorelik et al. | 381/355 |
| 2008/0192962 | A1 * | 8/2008 | Halteren | 381/170 |

FOREIGN PATENT DOCUMENTS

| | | | |
|---|---|---|---|
| DE | 3415088 | C1 | 9/1985 |
| DE | 4307825 | C2 | 10/1997 |
| DE | 19715365 | A1 | 10/1998 |

* cited by examiner

*Primary Examiner* — Davetta W Goins
*Assistant Examiner* — Phan Le
(74) *Attorney, Agent, or Firm* — Kilpatrick Townsend & Stockton LLP

(57) ABSTRACT

There is provided a microphone comprising a housing (2) which has at least one sound inlet opening (3) to connect the internal volume of the housing (2) with the volume surrounding the housing (2), and a first electroacoustic transducer (4) and a second electroacoustic transducer (5) which are symmetrically arranged in mutually opposite relationship in the housing (2), wherein a circuit board (7) is arranged between the first electroacoustic transducer (4) and the second electroacoustic transducer (5) and wherein the circuit board (7) has a slot (8) in the region of the sound inlet opening (3) of the housing (2).

9 Claims, 2 Drawing Sheets

MICROPHONE

CROSS-REFERENCE TO RELATED APPLICATIONS

Figure 1:
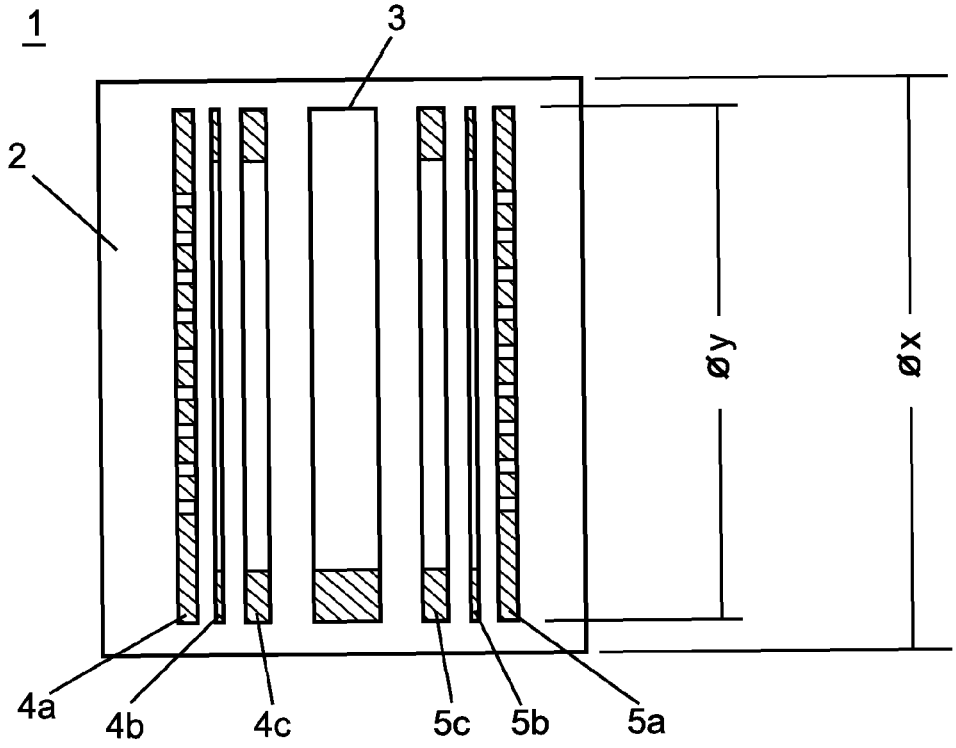

This application claims priority to German Patent Application No. 102008058787.7, filed Nov. 24, 2008, the disclosure of which is hereby incorporated by reference in its entirety.

The present invention concerns a microphone.

Various embodiments of microphones are known, which can be distinguished on the basis of their transducer principles or their acoustic design.

In regard to the acoustic design of a microphone a distinction is made as to whether the diaphragm of the microphone follows either the sound pressure or the sound pressure gradient. Those microphones are correspondingly referred to as a pressure microphone or a pressure gradient microphone. In that respect the acoustic design is decisive in regard to the directional characteristic and the frequency response. Accordingly pressure microphones represent non-directional microphones while pressure gradient microphones are directional microphones.

The technical quality of the microphone signal is heavily dependent on the operating principle of the transducer. In that respect the transducer principles can be distinguished in terms of dynamic microphones, capacitor microphones, electret capacitor microphones, carbon microphones and piezoelectric or crystal microphones.

Capacitor microphones operate on the basis of the physical principle of a capacitor. That means that two metal plates are mounted in electrically insulated relationship at a very close spacing from each other, the one metal plate being fixed and the other being in the form of a very thin metal diaphragm. In that respect the electrically conductive diaphragm is generally only a few thousandths of millimeter thick and the metal plate is often perforated for acoustic reasons. A voltage is applied with a voltage source across the two conductive metal plates, whereby the two metal plates act as a capacitor which is charged up by way of the voltage source. As soon as an electric voltage is applied a potential drop occurs between the diaphragm and the plate. The incoming sound causes the metal plate serving as the diaphragm to oscillate, whereby the spacing of the two capacitor plates relative to each other changes. As a result the capacitance of the capacitor also alters. Those fluctuations in capacitance between the two capacitor plates lead to voltage fluctuations and thus an electric signal which is caused by the incoming sound. Accordingly the capacitor microphone corresponds to an electroacoustic transducer which converts sound pressure pulses into corresponding electric voltage pulses, wherein the electric signal of the capacitor microphone results from diaphragm deflection itself and not from the diaphragm speed, that is to say the signal corresponds to the magnitude of the diaphragm deflection and not the speed of change in the diaphragm deflection.

Capacitor microphones can be divided into small and large diaphragm capacitor microphones which differ primarily in terms of their sensitivity and reverse loss. In that case the diaphragm diameter of the microphone capsule is considered. That decisively influences the sound and in that way determines the purpose of use of the microphone. The smaller the respective capsule diameter, the correspondingly higher frequencies can be correctly recorded in accordance with their direction of incidence and their sound intensity and transmitted as the microphone ideally approaches the punctiform one if the diaphragm diameter is below half the wavelength of the highest audible audio frequencies. In that respect the wavelength is at 20 kHz at about 16 mm. That gives rise to the conclusion that, the smaller the respective capsule, the correspondingly more neutral and more precise is the acoustic pattern of the recorded sound.

The limit between a small and a large diaphragm is drawn with a diaphragm diameter for the microphone capsule of 1 inch which approximately corresponds to 2.54 cm. In that respect diameters of ½ inch (1.3 cm) and ¼ inch (0.64 cm) are usual for small diaphragm capacitor microphones. By virtue of their approximation to the punctiform ideal at frequencies of over about 20 kHz small diaphragm capacitor microphones therefore have a quite uniform configuration in respect of sensitivity in dependence on the angle of inclination of the sound and substantially linearly transmit to far above 15 kHz. In contrast in the case of the large diaphragm capacitor microphones for example pronounced partial oscillations and interactions of the diaphragm occur with short sound waves so that an often irregular frequency configuration occurs in the upper frequency range from about 10 kHz. The size and geometry of the overall microphone are also jointly responsible in that respect. Due to the type of construction small diaphragm capacitor microphones also have an often necessary good reverse loss, that is to say shading of rearwardly arriving sound waves. Typical reverse loss values are up to 35 dB for cardioid small diaphragm capacitor microphones while only up to a maximum of 20 dB damping loss is usual from the rear for large diaphragms.

By virtue of their advantages in regard to sensitivity and reverse loss, small diaphragm capacitor microphones are almost exclusively used in relation to music production and transmissions in which sound authenticity is an important consideration as the sound image is correspondingly more neutral, the smaller the microphone capsule.

An example of a capacitor microphone is described in DE 43 07 825 C2 concerning a double transducer with a variable directional characteristic. That double transducer comprises a symmetrical arrangement of two transducers with cardioid directional characteristics facing in opposite directions. That capacitor microphone has a housing which connects the transducers and encloses the volumes thereof. The volumes are connected axially and radially symmetrically in the region of the housing to the space surrounding the transducer, by wide and also by narrow acoustic passages. The acoustic impedance as a whole is of a defined configuration which is constant at low frequencies and which rises towards high frequencies. In addition there is also a cardioid directional characteristic at low frequencies.

U.S. Pat. No. 5,335,282 also concerns a microphone having a plurality of oppositely oriented electroacoustic pairs of signal transducers. The pairs of signal transducers are disposed in a housing or in a cavity resonator and are electrically algebraically summed. In that case acoustic shock pulses and vibrations in the surroundings cause opposite electrical phase outputs while an acoustic signal which passes into an acoustic channel of the cavity resonator generates a damped, in-phase, summed output. In that way the signal-noise ratio is greatly improved and a high output level is generated, which is substantially non-microphonic.

The above-described minimicrophones which are in the form of small diaphragm capacitor microphones have in common the fact that, with an increasing reduction in the dimensions of the microphone, the diaphragm capacitor area is also reduced whereby there is also a drop in sensitivity, that is to say the capability of converting a given sound pressure into a voltage which is as high as possible. With a downstreamconnected amplifier with a certain background noise the signal-to-noise ratio is also worsened as a result.

The object of the invention is to improve the technical data of small microphones with the same structural size or to reduce the structural size of the small microphones with the same technical data, than in the case of known small microphones.

That object is attained by a microphone as set forth in claim 1.

Thus there is provided a microphone comprising a housing which has at least one sound inlet opening in order to connect the internal volume of the housing with the volume surrounding the housing, and a first electroacoustic transducer and a second electroacoustic transducer which are symmetrically arranged in mutually opposite relationship in the housing, wherein a circuit board is arranged between the first electroacoustic transducer and the second electroacoustic transducer and wherein the circuit board has a slot in the region of the sound inlet opening of the housing.

An advantage of the microphone according to the invention is that two electroacoustic transducers for receiving the acoustic signal are used in one microphone. In that way the received input signal is also increased by virtue of the increased diaphragm surface areas, whereby a correspondingly greater output signal is to be expected. In other words, with the microphone being of the same dimensions, the area of the diaphragm capacitors is increased whereby there is also an increase in the sensitivity of the microphone, that is to say the capability of converting a given sound pressure into a voltage which is as high as possible. The increase in the area of the diaphragm capacitors by virtue of using two electroacoustic transducers therefore also increases the sensitivity of a microphone without in that case increasing the structural size. As an alternative it is also possible in that way to reduce the structural size with the same level of sensitivity.

In accordance with an aspect of the present invention the microphone is in the form of a capacitor microphone.

In accordance with a further aspect of the invention the first electroacoustic transducer and the second electroacoustic transducer each have an electrically conductive thin metal diaphragm which is separated from a counter-electrode in insulated relationship by a spacer ring.

In accordance with an aspect of the present invention the first electroacoustic transducer and the second electroacoustic transducer are respectively connected to an impedance or amplifier stage. In that way the voltages as output signals from the two electroacoustic transducers are amplified by the two impedance or amplifier stages. In that way the received signal is amplified more greatly than the noise, which is also received, of the input signal. Thus the signal-to-noise ratio is improved and in that way better use is achieved than without the two impedance or amplifier stages.

In accordance with an aspect of the present invention the first impedance or amplifier stage is connected electrically in parallel with the first electroacoustic transducer and the second impedance or amplifier stage is connected electrically in parallel with the second electroacoustic transducer.

In accordance with an aspect of the present invention the first impedance or amplifier stage of the first electroacoustic transducer is arranged on the one side of the circuit board and the second impedance or amplifier stage of the second electroacoustic transducer is arranged on the other side of the circuit board. That means that the impedance or amplifier stages are arranged within the volume enclosed by the housing. That arrangement means that the impedance or amplifier stages are provided in a space-saving fashion in the microphone so that an improvement in the signal-to-noise ratio can be achieved without increasing the structural size of the microphone, by virtue of the use of the impedance or amplifier stages.

In accordance with an aspect of the present invention the slot in the circuit board is wider than the sound inlet opening of the housing. That provides that the entry of sound into the housing is not adversely affected by the circuit board. That means that the sound passes without being adversely affected through the sound inlet opening into the volume enclosed by the housing and can be unimpededly propagated in the volume. Thus the propagation of sound is not influenced by the circuit board and the circuit board also does not have any noticeable adverse influence on reception of the sound by the electroacoustic transducers in the interior of the housing.

In accordance with an aspect of the present invention the sound inlet opening of the housing is arranged laterally in the housing.

In accordance with an aspect of the present invention the sound inlet opening of the housing is arranged perpendicularly to the vertical axis of the two electroacoustic transducers. In that way the sound inlet opening forms the axis of symmetry of the housing and thus also the volume enclosed by the housing. As a result the sound which enters through the sound inlet opening is similarly propagated on both sides of the circuit board and is also received in equal parts by the two electroacoustic transducers. That leads to two identical input signals in relation to both electroacoustic transducers whereby evaluation and utilization of the signals is simplified. Two identical impedance and amplifier stages can be correspondingly provided in the microphone.

Embodiments by way of example and advantages of the invention are described in greater detail hereinafter with reference to the Figures.

Figure 2:
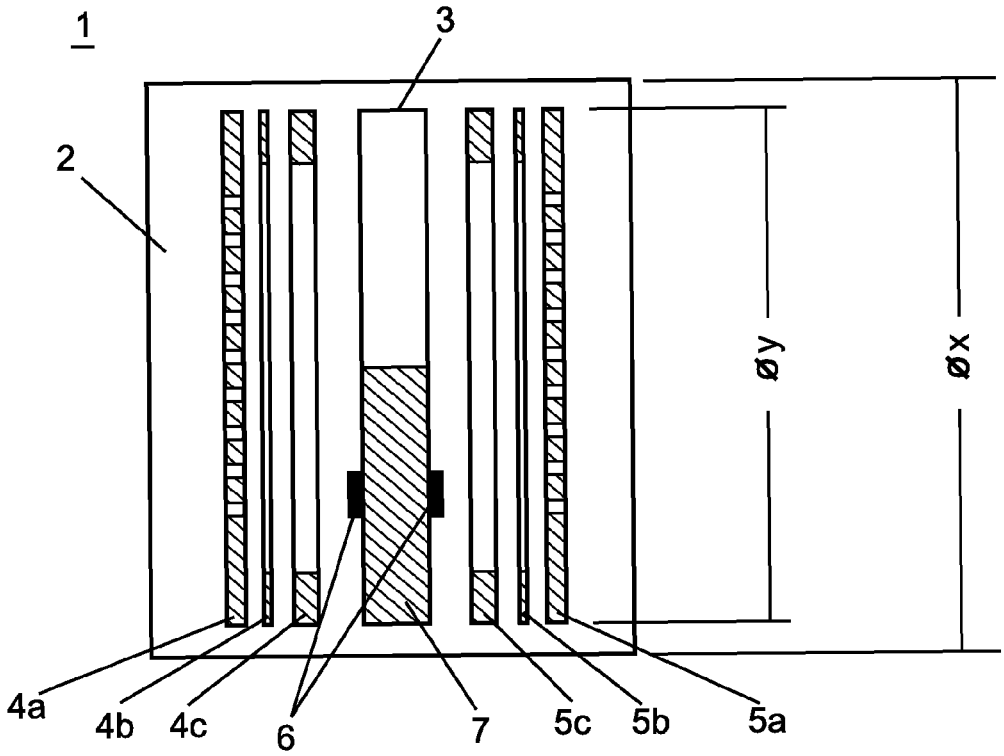
Figure 3:
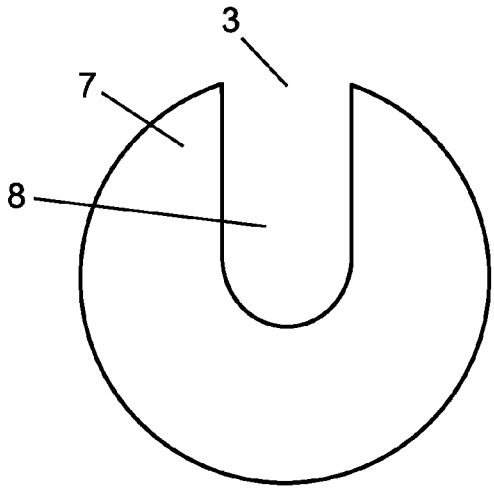
Figure 4:
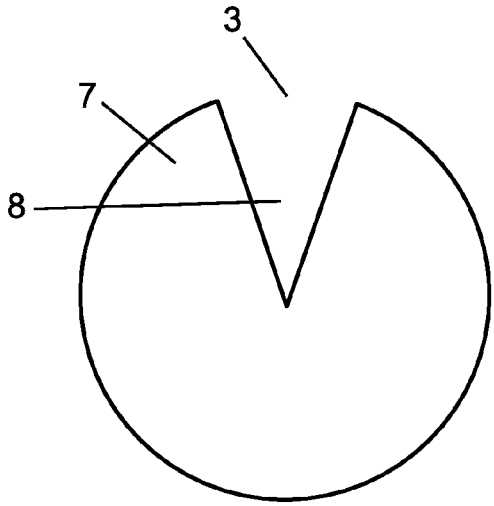
Figure 5:
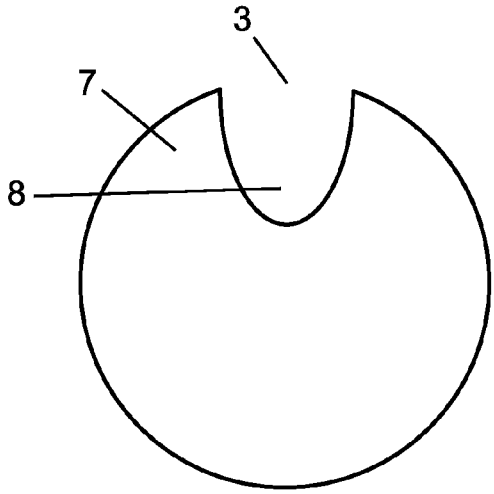

FIG. 1 shows a side view of a microphone in accordance with a first embodiment, FIG. 2 shows a side view of a microphone in accordance with a second embodiment, FIG. 3 shows a plan view of a circuit board with a slot of a microphone according to the second embodiment, FIG. 4 shows a plan view of a circuit board with a slot of a microphone according to the second embodiment, and FIG. 5 shows a plan view of a circuit board with a slot of a microphone according to the second embodiment.

FIG. 1 shows a side view of a microphone in accordance with a first embodiment. In order to be able to more clearly distinguish the components from each other they are shown in a condition of being moved away from each other. Thus the microphone 1 has a housing 2 in which the components of the microphone 1 are arranged. In this case the housing 2 has a sound inlet opening 3, through which sound from the volume surrounding the housing 2 can penetrate into the internal volume of the housing 2. That means that the sound inlet opening 3 connects the inner and outer volumes of the housing 2 together in such a way that sound can be received in the interior of the housing 2. In that respect the sound inlet opening 3 can be completely open or can also be provided with materials which prevent dirt or moisture from penetrating into the interior of the housing 2 or cause a desired acoustic effect. It is also possible in that way to prevent damage to the components in the interior of the housing 2.

In addition the sound inlet opening 3 can be both in the form of a single opening and also in the form of a divided opening, that is to say instead of a single large opening a plurality of smaller openings are also possible, the areas of which can correspond in total to the area of a single large opening. That also makes it possible to prevent dirt from penetrating into the interior of the housing 2. For example the individual smaller openings can be smaller than the possible particles of dirt. It is also possible in that way to prevent damage to the components in the interior of the housing 2.

The contour of the sound inlet opening 3 is not limited in respect of its geometry. Thus the sound inlet opening 3 can be for example of a constant width. It will be noted however that it is also conceivable for the contour of the sound inlet opening 3 to be altered for example in its width. In that way it is also possible to influence the acoustic performance of the microphone 1, and to provide protection from the ingress of dirt and damage to the components in the interior of the housing 2.

A first electroacoustic transducer 4 and a second electroacoustic transducer 5 are disposed in the internal volume of the housing 2. Those electroacoustic transducers 4 and 5 are symmetrically arranged in mutually opposite relationship in the housing 2. The two electroacoustic transducers 4 and 5 can be arranged with their axial axis of symmetry on the axial axis of symmetry of the housing 2. The receiver sides or the sound inlet openings of the two electroacoustic transducers 4 and 5 can in that case be directed towards each other. As a result the electroacoustic transducers 4 and 5 enclose the internal volume of the housing 2 from the two sides of the axial axis of symmetry while the sound inlet opening 3 is arranged on the radial peripheral surface of the housing 2.

FIG. 1 further shows the structure of the electroacoustic transducers 4 and 5. They each have an electrically conductive thin metal diaphragm 4*c* and 5*c* which are respectively separated and isolated from a counter-electrode 4*a* and 5*a* by a spacer ring 4*b* and 5*b*. In that arrangement the electroacoustic transducers 4 and 5 are arranged in the internal space of the housing 2 in such a way that the spacer rings 4*c* and 5*c* are towards the circuit board 7. In that case the metal diaphragms 4*c* and 5*c*, the counter-electrodes 4*a* and 5*a*, the spacer rings 4*b* and 5*b* as well as the circuit board 7 can be arranged in directly mutually juxtaposed relationship in the direction of the symmetrical center line of the electroacoustic transducers 4 and 5 and of the housing 2 or can be spaced relative to each other by further components.

The sensitivity of the microphone 1 can be increased by the two electroacoustic transducers 4, 5 as, in contrast to known microphones, two electroacoustic transducers 4 and 5 are used for converting the sound into electrical signals, instead of only one electroacoustic transducer. At the same time the arrangement according to the invention of the electroacoustic transducers 4 and 5 in the housing 2 means that no additional structural space is required to provide the second of the two electroacoustic transducers 4 and 5 in the microphone 1. The sound inlet opening 3 makes it possible for the sound to reach the two electroacoustic transducers 4 and 5 from the exterior. Therefore this first embodiment of a microphone 1 according to the present invention allows an increase in the sensitivity of the microphone 1 while the microphone 1 is of the same structural size. Equally a microphone 1 of the first embodiment can be designed in such a way that the same sensitivity is achieved with two electroacoustic transducers 4 and 5, as with one electroacoustic transducer, with the microphone 1 being of a markedly smaller structural size.

FIG. 2 shows a side view of microphone in accordance with a second embodiment. In addition to the components of the first embodiment the microphone 1 has a circuit board 7 between the two electroacoustic transducers 4 and 5. In that case the circuit board 7 is also arranged with its center line on the common axial axis of symmetry of the first electroacoustic transducer 4, the second electroacoustic transducer 5 and the housing 2. Furthermore the circuit board 7 is arranged directly on the radial plane on which the sound inlet opening 3 is provided in the housing 2, see also FIG. 3. That radial plane on which both the sound inlet opening 3 and also the circuit board 7 are disposed is at the same time the plane of symmetry of the two electroacoustic transducers 4 and 5.

FIG. 3 shows a plan view of a circuit board with a slot of a microphone according to the second embodiment. The circuit board 7 can be in the form of a wafer. However so that the circuit board which is arranged in the same radial plane as the sound inlet opening 3 does not partially or completely close the sound inlet opening 3 and thereby impede or prevent sound from passing from the exterior into the internal volume of the housing 2, the circuit board 7 has a slot 8 in the region of the sound inlet opening 3 of the housing 2. In that way sound can pass into internal volume of the housing 2 from the exterior and can be accordingly received by the electroacoustic transducers 4 and 5.

FIG. 4 shows a plan view of a circuit board with slot of a microphone according to the second embodiment. In this case the slot 8 in the circuit board 7 can be of a different configuration. Thus for example the width of the slot 8 can be varied. In that respect the slot 8 on the circuit board 7 can be of a constant width over its depth, as shown in FIG. 3. It will be noted however that a slot 8 in the shape of an apex of a cone is also possible, in which the width of the slot 8 uniformly increases with the radius outwardly to the sound inlet opening 3 so that the slot 8 is of the same width in terms of angular dimension at each radius.

FIG. 5 shows a plan view of a circuit board with slot of a microphone according to the second embodiment. In this case the slot 8 can be of a differing depth in the radial direction from the center line of the circuit board 7 relative to the housing 2 and thus relative to the sound inlet opening 3. Thus the slot 8 can be very deep in the radial direction as far as the center line of the circuit board 7 or beyond that line, as shown in FIG. 3. Equally it is possible for that slot 8 to be radially only very small. In addition it is also possible to select any asymmetrical and irregular shapes for the slot 8.

Those different implementations of the slot 8 in the circuit board 7 in shape, width and depth in the plane of the circuit board 7 and the sound inlet opening 3 make it possible to specifically and targetedly influence propagation of the sound in the internal volume of the housing 2 and therewith the acoustic behavior of the microphone 1.

To amplify the signals received by the two electroacoustic transducers 4 and 5 it is possible to provide a respective impedance or amplifier stage 6 for each of the two electroacoustic transducers 4 and 5. In that respect a respective impedance or amplifier stage 6 is connected electrically in parallel with one of the electroacoustic transducers 4 or 5 respectively. In that way the signal respectively received from the electroacoustic transducers 4 and 5 is amplified. In that case the useful signal is amplified in each case more greatly than interference signals which can also be referred to as noise. That achieves an improvement in the signal-to-noise ratio.

Those two impedance or amplifier stages 6 are respectively arranged on the corresponding side of the circuit board 7 of the respective electroacoustic transducers 4 or 5, with which they are electrically connected in parallel. That means that an impedance or amplifier stage 6 is arranged on the side of the circuit board 7, that is towards the one electroacoustic transducer 4 and is electrically coupled thereto in parallel, and the other impedance or amplifier stage 6 is arranged on the side of the circuit board 7, that is towards the other electroacoustic transducer 5 and is electrically coupled in parallel therewith. The arrangement of the impedance or amplifier stages 6 on the circuit board 7 provides that two impedance or amplifier stages 6 can be provided in the microphone 1 for the electroacoustic transducers 4 and 5 without increasing the structural size of the microphone 1. In that way it is possible to achieve an improvement in the signal-to-noise ratio with the microphone 1 being of the same structural size.

The invention concerns the notion of providing a microphone having two diaphragms which each operate on a respective electrode. A greater output signal is to be expected due to the diaphragm area which is increased in that way. In addition two impedance or amplifier stages which are connected in parallel are also arranged in series with the diaphragms so that electrical noise is reduced thereby.

It would also be possible to provide a microphone having only one electrode and two diaphragms. Then however only one impedance or amplifier circuit is possible. A reduction in external geometry is however nonetheless possible.

The above-described microphone can be in the form of a minimicrophone.

The invention claimed is:

1. A microphone comprising:

a housing which has at least one sound inlet opening and an internal volume to connect the internal volume of the housing with a volume surrounding the housing, and a first electroacoustic transducer and a second electroacoustic transducer which are symmetrically arranged in mutually opposite relationship in the housing defining a plane of symmetry between the first and the second electroacoustic transducer, wherein a circuit board is arranged between the first electroacoustic transducer and the second electroacoustic transducer, wherein the sound inlet opening and the circuit board are disposed along the plane of symmetry and wherein the circuit board has a slot in the region of the sound inlet opening of the housing without closing the sound inlet opening.

2. A microphone as set forth in claim 1 wherein the microphone is in the form of a capacitor microphone.

3. A microphone as set forth in claim 2 wherein the first electroacoustic transducer and the second electroacoustic transducer each have an electrically conductive thin metal diaphragm which is separated from a counter-electrode in insulated relationship by a spacer ring.

4. A microphone as set forth in claim 1 wherein the first electroacoustic transducer and the second electroacoustic transducer are respectively connected to an impedance or amplifier stage.

5. A microphone as set forth in claim 4 wherein the first impedance or amplifier stage is connected electrically in parallel with the first electroacoustic transducer and the second impedance or amplifier stage is connected electrically in parallel with the second electroacoustic transducer.

6. A microphone as set forth in claim 4 wherein the first impedance or amplifier stage of the first electroacoustic transducer is arranged on the one side of the circuit board and the second impedance or amplifier stage of the second electroacoustic transducer is arranged on the other side of the circuit board.

7. A microphone as set forth in claim 1 wherein the slot in the circuit board is wider than the sound inlet opening of the housing.

8. A microphone as set forth in claim 1 wherein the sound inlet opening of the housing is arranged laterally in the housing.

9. A microphone as set forth in claim 8 wherein the sound inlet opening of the housing is arranged perpendicularly to the vertical axis of the two electroacoustic transducers.

* * * * *

UNITED STATES PATENT AND TRADEMARK OFFICE

CERTIFICATE OF CORRECTION

PATENT NO. : 8,213,661 B2
APPLICATION NO. : 12/622696
DATED : July 3, 2012
INVENTOR(S) : Hinke It is certified that error appears in the above-identified patent and that said Letters Patent is hereby corrected as shown below:

In the Specification:

Column 4, Line 28: please delete “is” and insert --are--.

Column 5, Line 59: before “microphone” please insert --the--.

Column 6, Line 28: before “slot” please insert --a--.

Signed and Sealed this
Eighth Day of January, 2013

David J. Kappos

David J. Kappos
*Director of the United States Patent and Trademark Office*